US006543265B1

(12) United States Patent
Fan

(10) Patent No.: US 6,543,265 B1
(45) Date of Patent: Apr. 8, 2003

(54) DOOR LOCK-AND-HANDLE ASSEMBLY

(76) Inventor: Fang-Yi Fan, No. 186, Min-Kuo Rd., Chia-Yi City (TW)

( * ) Notice: Subject to any disclaimer, the term of this patent is extended or adjusted under 35 U.S.C. 154(b) by 0 days.

(21) Appl. No.: 10/002,474

(22) Filed: Nov. 15, 2001

(51) Int. Cl.[7] ..... E05B 59/00

(52) U.S. Cl. ..... 70/224; 70/107; 70/467; 70/478; 70/210; 70/215; 292/5; 292/93; 292/336.3

(58) Field of Search ..... 70/107, 224, 467, 70/478, 475, 484, 485, 210, 215; 292/93, 92, 336.3

(56) References Cited

U.S. PATENT DOCUMENTS 722,620 A * 3/1903 Phelps ..... 70/110
2,651,934 A * 9/1953 Chesler ..... 70/485
3,147,608 A * 9/1964 Turner et al. ..... 70/468
3,677,591 A * 7/1972 Waldo ..... 292/221
4,101,153 A * 7/1978 Dozier ..... 292/92
4,236,396 A * 12/1980 Surko et al. ..... 70/107
4,838,053 A * 6/1989 Shen ..... 70/92
5,941,108 A * 8/1999 Shen ..... 70/467
6,302,453 B1 * 10/2001 Norton ..... 292/169.21
6,357,807 B1 * 3/2002 Fan ..... 292/226
6,361,090 B1 * 3/2002 Fan ..... 292/336.3

* cited by examiner

*Primary Examiner*—Lloyd A. Gall
*Assistant Examiner*—Christopher Boswell
(74) *Attorney, Agent, or Firm*—Harness, Dickey & Pierce, P.L.C.

(57) ABSTRACT

A door lock-and-handle assembly includes a housing receiving a latch bolt and a dead bolt adjacent to the latch bolt, an escutcheon defining a recess, a handle mounted on the escutcheon, a spindle coupled to the dead bolt, a locking member received in the recess and movable to a locked position to prevent turning of the handle when the dead bolt is moved to an extended position, and a lock releasing member extending from the dead bolt and capable of driven by the latch bolt so as to move the dead bolt from the extended position to a retracted position and the locking member from the locked position to an unlocked position when the latch bolt turns from an extended position to a retracted position.

8 Claims, 10 Drawing Sheets

DOOR LOCK-AND-HANDLE ASSEMBLY

BACKGROUND OF THE INVENTION

This invention relates to a door lock-and-handle assembly, more particularly to a door lock-and-handle assembly with a lock releasing member.

The object of the present invention is to provide a door lock-and-handle assembly with a lock releasing member for preventing undesirable locking action of a lock thereof.

SUMMARY OF THE INVENTION

According to the present invention, a door lock-and-handle assembly comprises: a bolt receiving housing adapted to be mounted on an inner side of a door panel and having a side wall that is formed with a bolt opening; a latch bolt mechanism including a latch bolt mounted movably in the bolt receiving housing and turnable between first extended and retracted positions for moving in and out of the bolt opening, and a latch biasing member that urges the latch bolt to turn toward the first extended position; a dead bolt mounted slidably in the bolt receiving housing adjacent to the latch bolt, and slidable in a transverse direction relative to the side wall between second extended and retracted positions for moving in and out of the bolt opening; an escutcheon adapted to be mounted on an outer side of the door panel, aligned with the bolt receiving housing, and having a mounting wall that is formed with a lock receiving recess which is defined by a recess-confining wall, a spindle hole which is defined by a hole-confining wall extending from the recess-confining wall in an axial direction, and at least an engaging groove which is defined by a groove-confining wall extending from the recess-confining wall in a radial direction relative to the axial direction; a handle mounted turnably on the mounting wall of the escutcheon, surrounding the spindle hole, formed with a keyhole that is aligned with the spindle hole in the axial direction, and having a driving member that extends through the spindle hole and the lock receiving recess and that is turnably coupled to the latch bolt so as to move the latch bolt between the first extended and retracted positions; a spindle adapted to be turned by a key that is inserted into the keyhole, defining an axis in the axial direction, extending through the spindle hole, the lock receiving recess, and the door panel in the axial direction, and turnably coupled to the dead bolt so as to move the dead bolt between the second extended and retracted positions upon turning about the axis, the spindle having an engaging portion; at least a locking member received in the lock receiving recess and having a central part that is formed with a spindle opening defined by an opening-confining wall, and an engaging tongue that projects from the central part and that is aligned with the engaging groove in the axial direction, the spindle extending through the spindle opening in a manner that the engaging portion is received in the spindle opening to turnably engage the opening-confining wall so that turning of the spindle from a first angular position to a second angular position results in radial movement of the locking member to a locked position, where the engaging tongue extends through the driving member and into the engaging groove to releasably engage the driving member and the engaging groove so as to prevent turning of the handle, and that turning of the spindle from the second angular position to the first angular position results in radial movement of the locking member to an unlocked position, where the engaging tongue disengages from the driving member and the engaging groove so as to permit turning of the handle; and a lock releasing member including a driven leg that projects from and that is movable together with the dead bolt so as to be disposed at a position proximate to the latch bolt when the dead bolt is positioned at the second extended position, and so as to be driven by the latch bolt to synchronously move the dead bolt from the second extended position to the second retracted position and the locking member from the locked position to the unlocked position when the latch bolt turns from the first extended position to the first retracted position, thereby permitting turning of the handle and preventing undesirable locking actions of the dead bolt and the locking member.

BRIEF DESCRIPTION OF THE DRAWINGS

In drawings which illustrate an embodiment of the invention.

DETAILED DESCRIPTION OF THE PREFERRED EMBODIMENT

FIGS. 1 to 5, 6A and 6B illustrate a preferred embodiment of a door lock-and-handle assembly of this invention that is adapted to be mounted on a door panel 11 which is formed with screw holes 115 and a spindle through hole 114.

Figure 7:
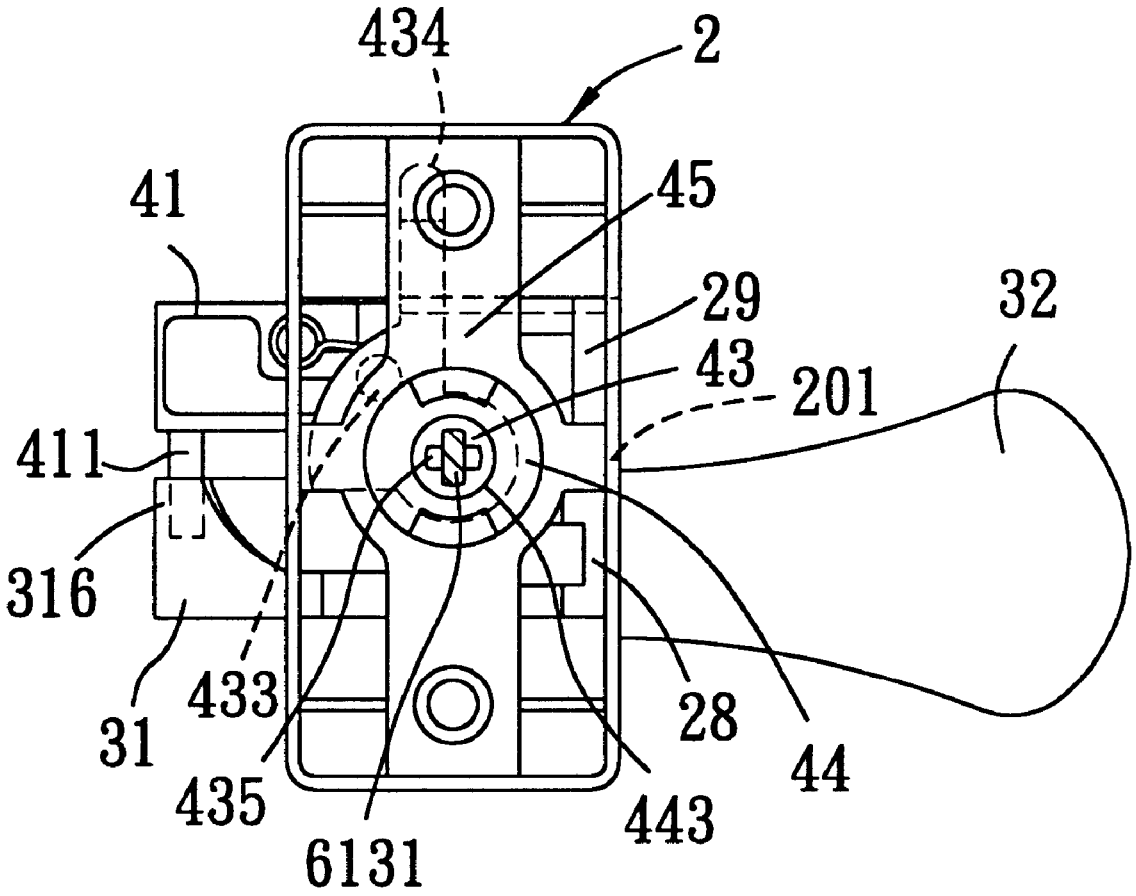
FIG. 7 is a front view of the bolt receiving housing with the dead bolt of FIG. 2 being positioned at an extended position.

The door lock-and-handle assembly is mounted on the door panel 11 via screw means 514 extending through the screw holes 115 and threadedly engaging the door lock-and-handle assembly, and includes: a bolt receiving housing 2 adapted to be mounted on the inner side 111 of the door panel 11 and having a first side wall 21 that is formed with a bolt opening 28; a latch bolt mechanism 3 including a latch bolt 31 mounted movably in the bolt receiving housing 2 and turnable between first extended and retracted positions (see FIGS. 6A and 6B) for moving in and out of the bolt opening 28 into a bolt hole 122 formed in a door frame 12 and offset from the door panel 11, and a latch biasing member 33 that urges the latch bolt 31 to turn toward the first extended position (the latch bolt 31 is forced to turn to the first retracted position against the biasing action of the latch biasing member 33 upon striking a striking plate 123 on the door frame 12); a dead bolt mechanism 4 that includes a dead bolt 41 mounted slidably in the bolt receiving housing 2 adjacent to the latch bolt 31, and slidable in a transverse direction relative to the first side wall 21 between second extended and retracted positions (see FIGS. 1, 5, 7 and 8) for moving in and out of the bolt opening 28; an escutcheon 51 adapted to be mounted on the outer side 112 of the door panel 11, aligned with the bolt receiving housing 2, and having a mounting wall 511 that is formed with a lock receiving recess 516 which is defined by a recess-confining wall, a spindle hole 515 which is defined by a hole-confining wall extending from the recess-confining wall in an axial direction, and at least an engaging groove 518 which is defined by a groove-confining wall extending from the recess-confining wall in a radial direction relative to the axial direction; a handle 52 mounted turnably on the mounting wall 511 of the escutcheon 51, surrounding the spindle hole 515, formed with a keyhole 528 that is aligned with the spindle hole 515 in the axial direction, and having a driving member 525' that extends through the spindle hole 515 and the lock receiving recess 516 and that is turnably coupled to the latch bolt 31 so as to move the latch bolt 31 between the first extended and retracted positions; a spindle 61 adapted to be turned by a key (not shown) that is inserted into the keyhole 528, defining an axis in the axial direction, extending through the spindle hole 515, the lock receiving recess 516, and the spindle through hole 114 in the door panel 11 in the axial direction, and turnably coupled to the dead bolt 41 so as to move the dead bolt 41 between the second extended and retracted positions upon turning about the axis, the spindle 61 having an engaging portion 616; at least a locking member 63 received in the lock receiving recess 516 and having a central part 631 that is formed with a spindle opening 634 defined by an opening-confining wall, and an engaging tongue 633 that projects from the central part 631 and that is aligned with the engaging groove 518 in the axial direction, the spindle 61 extending through the spindle opening 634 in a manner that the engaging portion 616 is received in the spindle opening 634 to turnably engage the opening-confining wall so that turning of the spindle 61 from a first angular position (see FIGS. 1 and 9A) to a second angular position (see FIGS. 8 and 9B) results in radial movement of the locking member 63 to a locked position (see FIG. 8, in combination with FIG. 4), where the engaging tongue 633 extends through the driving member 525' and into the engaging groove 518 to releasably engage the driving member 525' and the engaging groove 518 so as to prevent turning of the handle 52, and that turning of the spindle 61 from the second angular position to the first angular position results in radial movement of the locking member 63 to an unlocked position (see FIG. 1, in combination with FIG. 4), where the engaging tongue 633 disengages from the driving member 525' and the engaging groove 518 so as to permit turning of the handle 52; and a lock releasing member including a driven leg 411 that projects from and that is movable together with the dead bolt 41 so as to be disposed at a position (see FIG. 7) proximate to the latch bolt 31 when the dead bolt 41 is positioned at the second extended position, and so as to be driven by the latch bolt 31 to synchronously move the dead bolt 41 from the second extended position to the second retracted position and the locking member 63 from the locked position to the unlocked position when the latch bolt 31 turns from the first extended position to the first retracted position, thereby permitting turning of the handle 52 and preventing undesirable locking actions of the dead bolt 41 and the locking member 63.

The bolt receiving housing 2 is further formed with upper and lower partitions 29, 29' receiving the dead bolt 41 and the latch bolt 31 respectively therein, and a pair of vertically spaced apart guide rails 261 formed in the upper partition 29 and extending in: the transverse direction. The dead bolt 41 is formed with a sliding groove 410 that receives the guide rails 261 so as to guide sliding movement of the dead bolt 41. The latch bolt 31 includes an L-shaped wall that has a first wall portion 313 urged by the latch biasing member 33, and a second wall portion 314 transverse to the first wall portion 313. The latch bolt 31 further includes a curved wall 317 opposite to the first wall portion 313 and extending from and cooperating with one end of the second wall portion 314 to define a leg receiving recess 316 therebetween, and a stopper 315 releasably engaging the first side wall 21 of the bolt receiving housing 2 (see FIG. 6A) when the latch bolt 31 is positioned at the first extended position so as to limit extent of outward movement of the latch bolt 31 by the urging action of the latch biasing member 33. The driven leg 411 projects downwardly from a bottom end of the dead bolt 41 and is received in the leg receiving recess 316 when the dead bolt 41 is positioned at the second extended position so as to be driven by the second wall portion 314 when the latch bolt 31 turns from the first extended position to the first retracted position. The first and second wall portions 313, 314 of the latch bolt 31 cooperately define a corner formed with a pivot end 312 that is pivoted to the bolt receiving housing 2 via a pivot pin 35.

The dead bolt 41 is formed with a finger receiving groove 412, and includes a finger urging member 42 disposed adjacent to the finger receiving groove 412. The door lock-and-handle assembly further includes a dead bolt transmission 43 mounted turnably in the bolt receiving housing 2 and including a sector-shaped plate 431 disposed transverse to the first side wall 21 of the bolt receiving housing 2, and a driving finger 433 that projects from the sector-shaped plate 431 in the axial direction, that is received in and that engages the finger receiving groove 412 so as to permit the dead bolt transmission 43 to be turnable about the axis together with the sliding movement of the dead bolt 41, and that is urged by one end 421 of the finger urging member 42 so as to be retained in the finger receiving groove 412. The dead bolt transmission 43 further includes a cylindrical stud 432 that projects from the sector-shaped plate 431 in a direction opposite to the driving finger 433 and that is formed with a spindle engaging hole 435 which receives and which engages the spindle 61 so as to permit synchronous rotation of the dead bolt transmission 43 and the spindle 61 about the axis upon sliding movement of the dead bolt 41. The bolt receiving housing 2 further has a second side wall 22 opposite to the first side wall 21 and a top wall 25. A slot 201 is formed in and extends from the second side wall 22 to the top wall 25. A first bolt operating lever 434 extends outwardly of the bolt receiving housing 2 from the sector-shaped plate 431 through the slot 201 for actuating the dead bolt transmission 43 to move the dead bolt 41 between the second extended and retracted positions.

Figure 1:
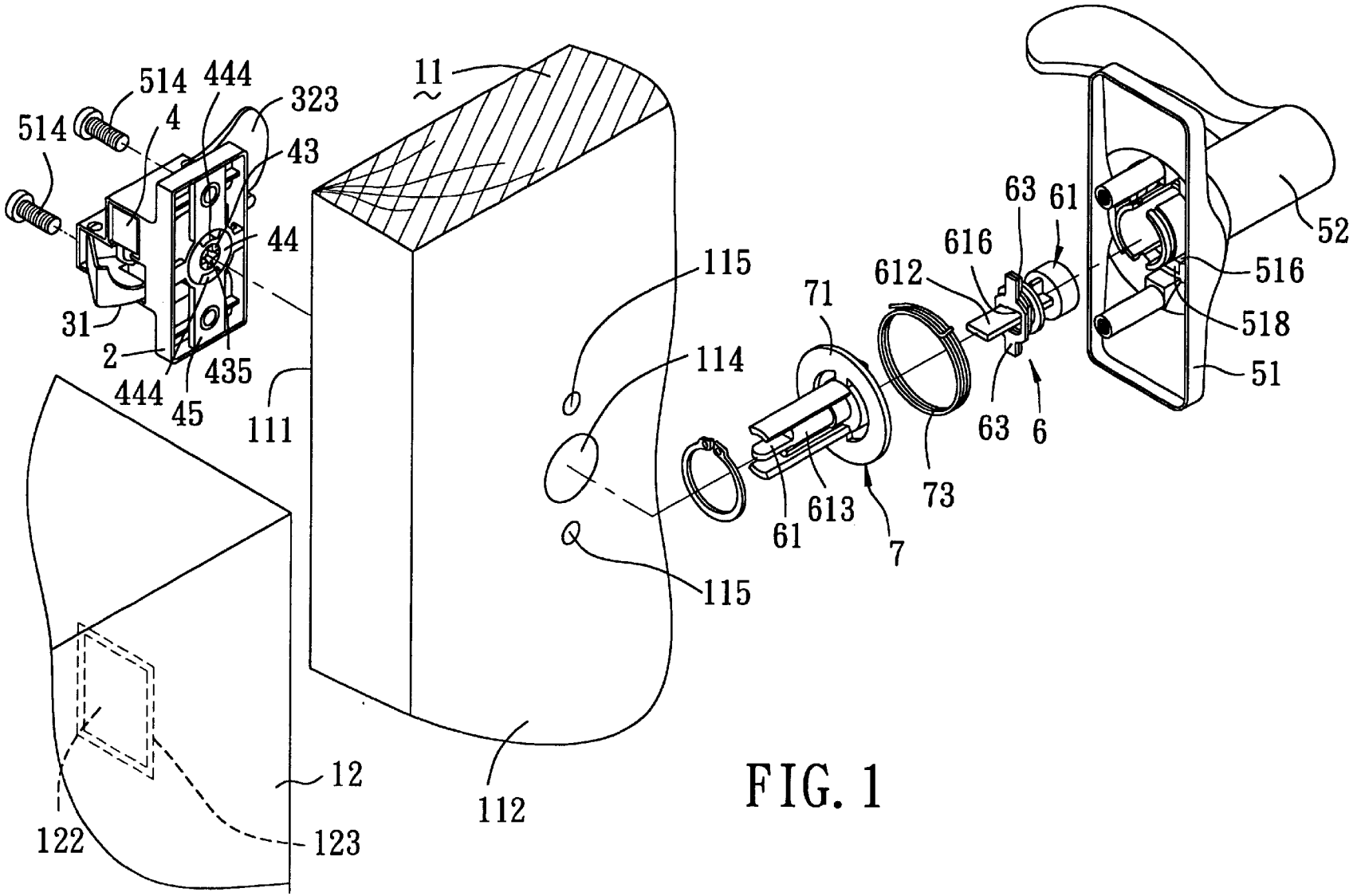
FIG. 1 is an exploded perspective view of a door lock-and-handle assembly embodying this invention.
Figure 2:
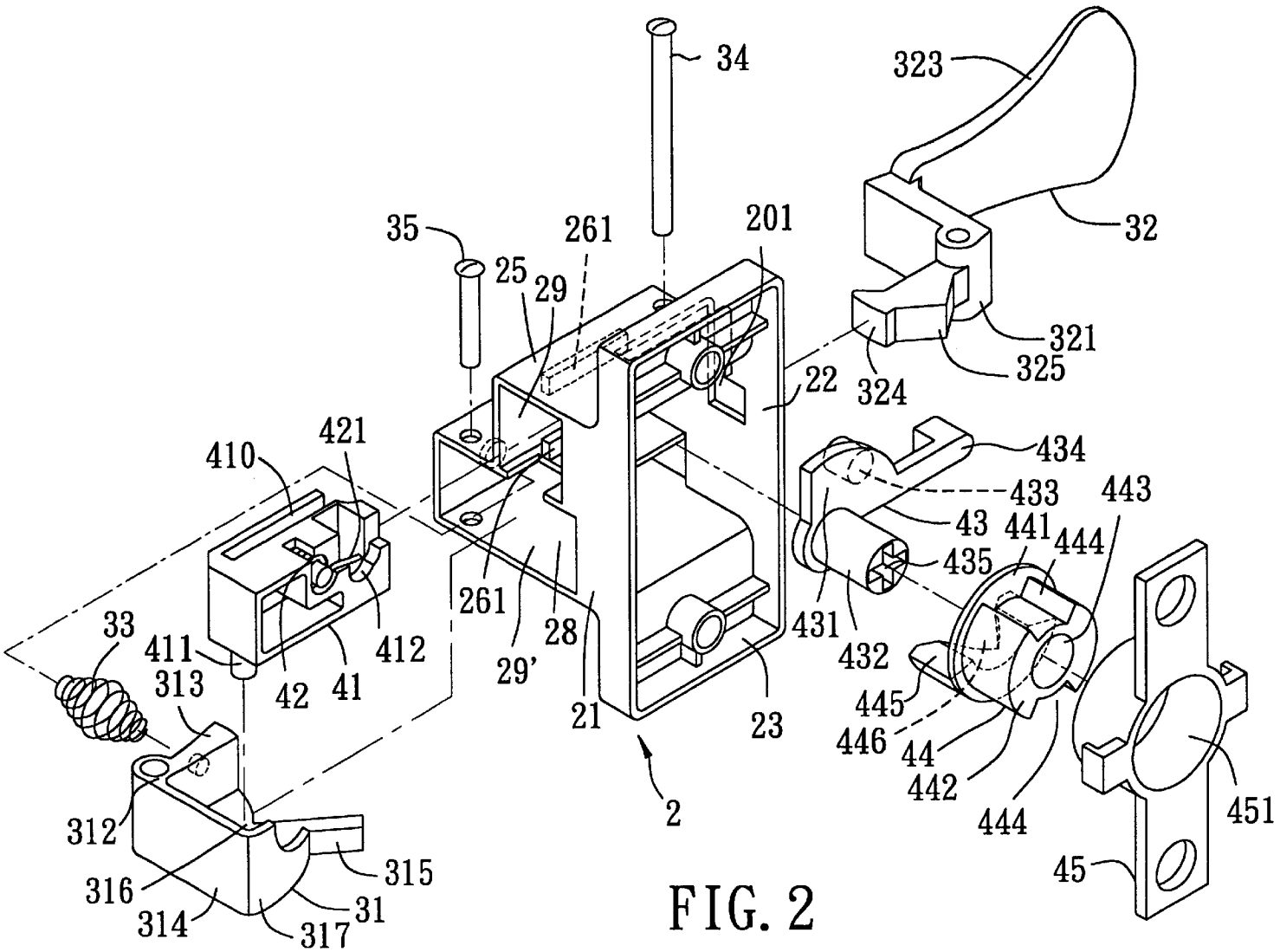
FIG. 2 is an exploded perspective view to illustrate how a latch bolt and a dead bolt of the door lock-and-handle assembly of FIG. 1 are operated.
Figure 3:
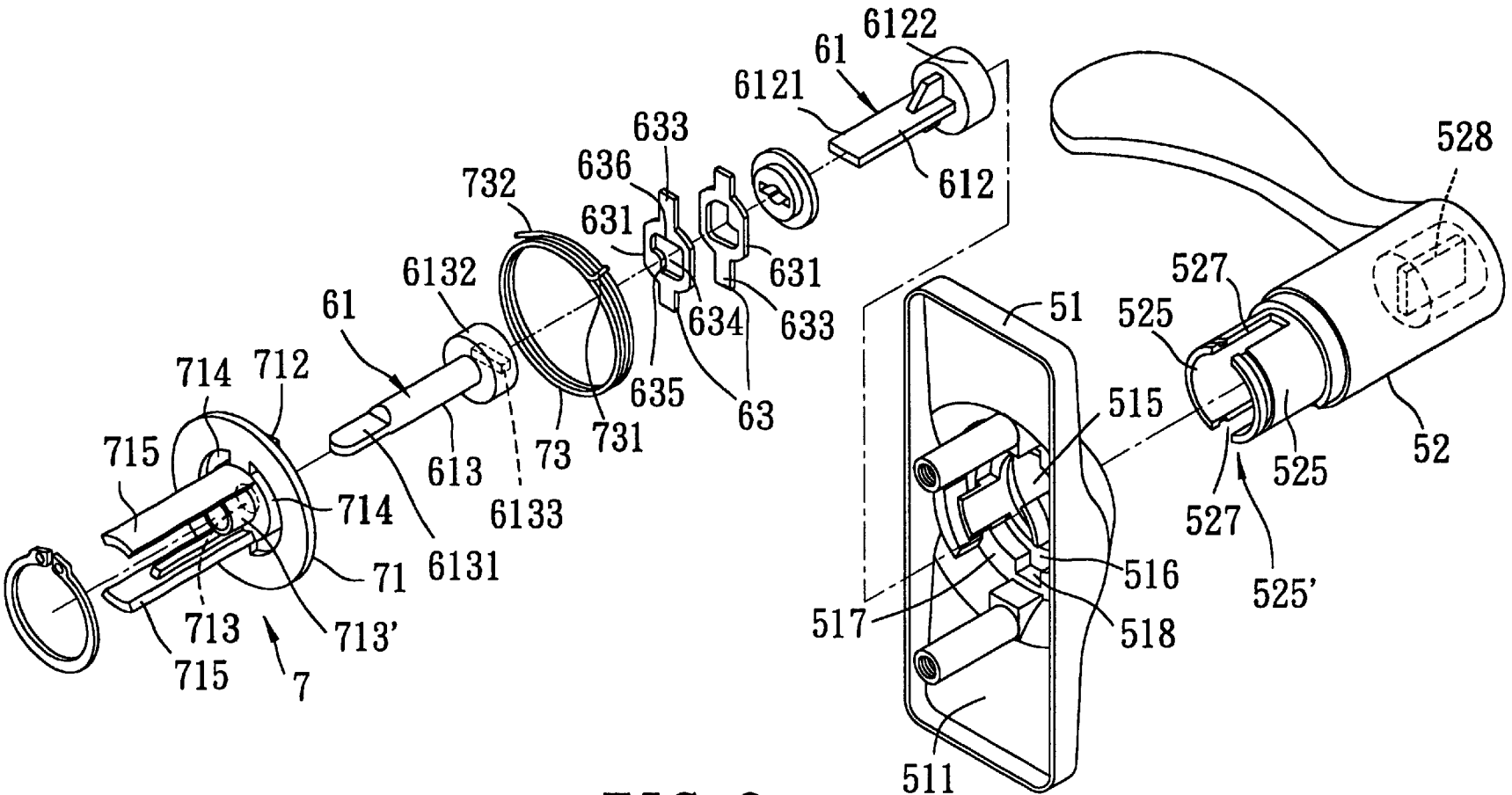
FIG. 3 is an exploded perspective view to illustrate how a locking member, a restoring member, and a handle of the door lock-and-handle assembly of FIG. 1 are operated.
Figure 4:
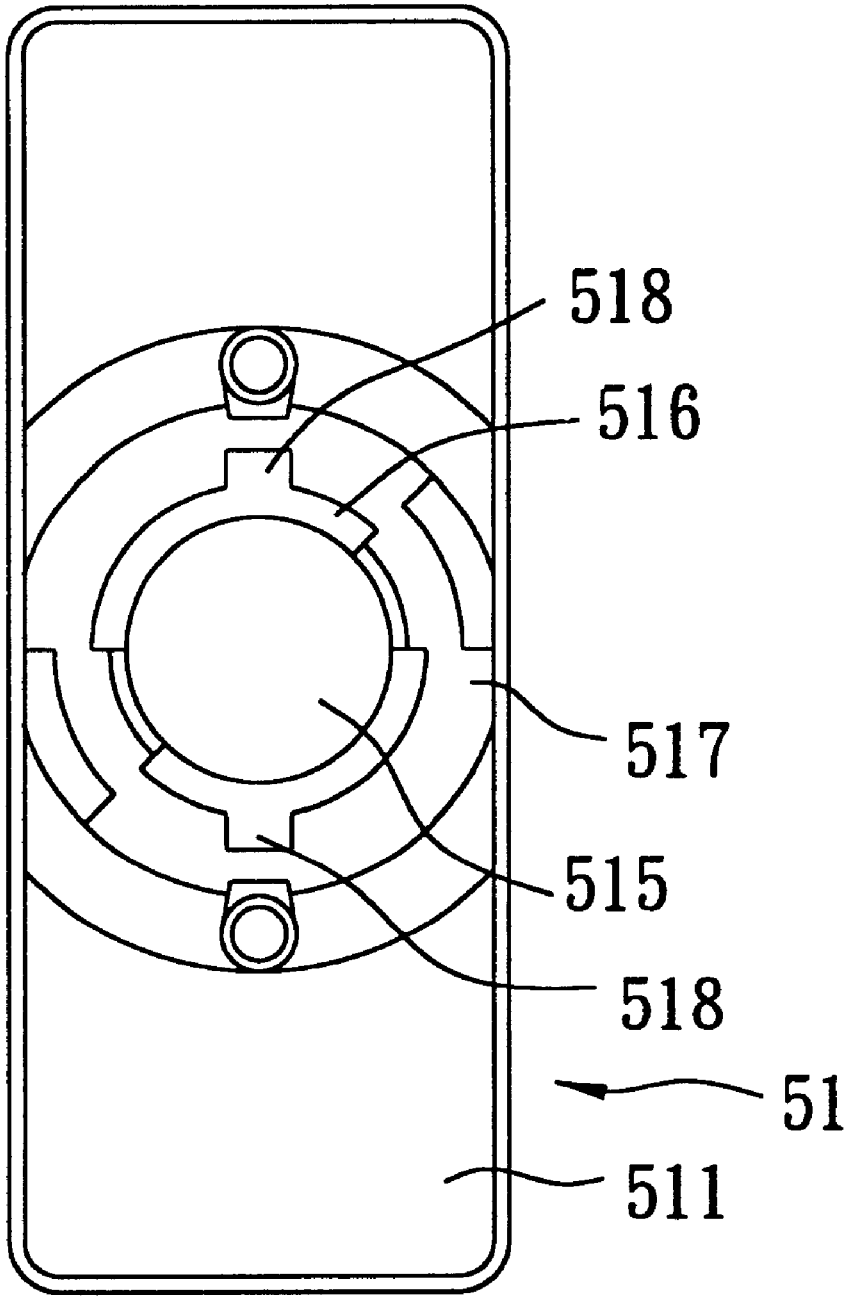
FIG. 4 is a rear view of an escutcheon of the door lock-and-handle assembly of FIG. 1.
Figure 5:
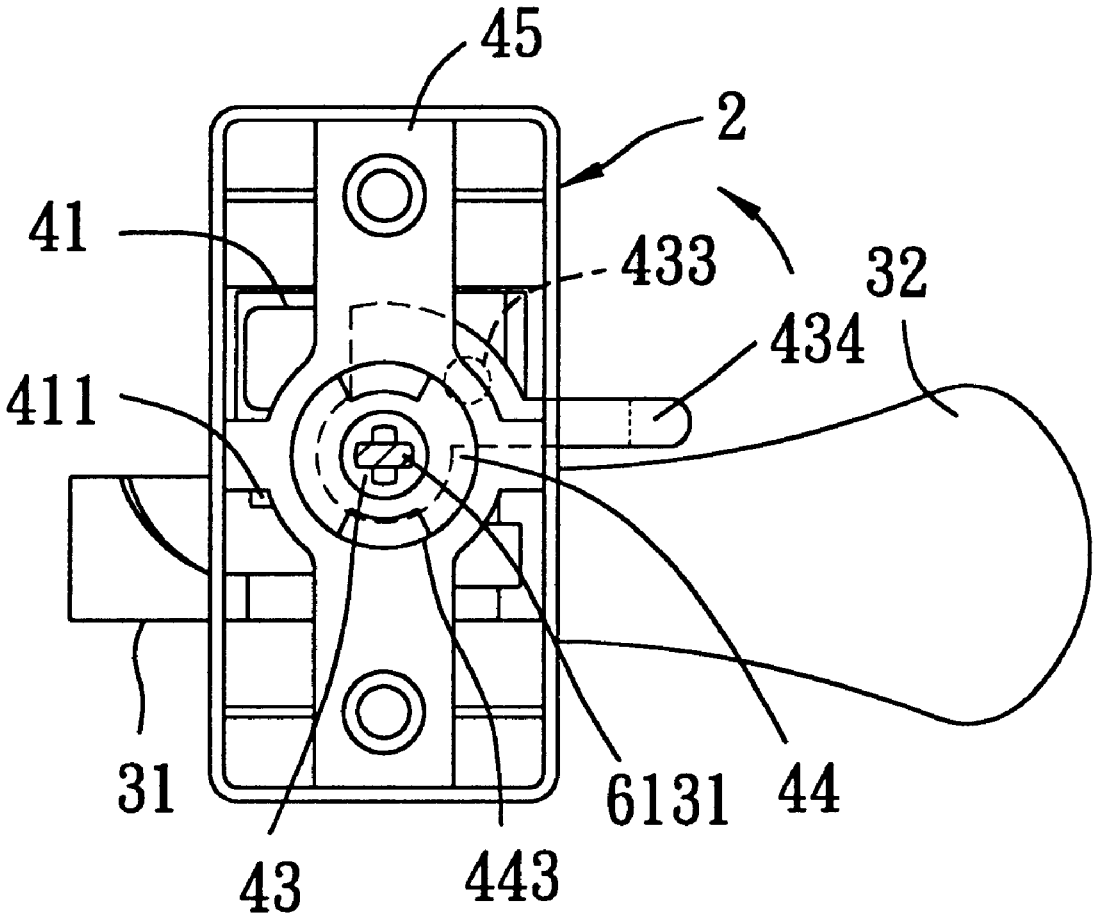
FIG. 5 is a front view of a bolt receiving housing with the latch bolt and the dead bolt of FIG. 2 being received therein.
Figure 6A:
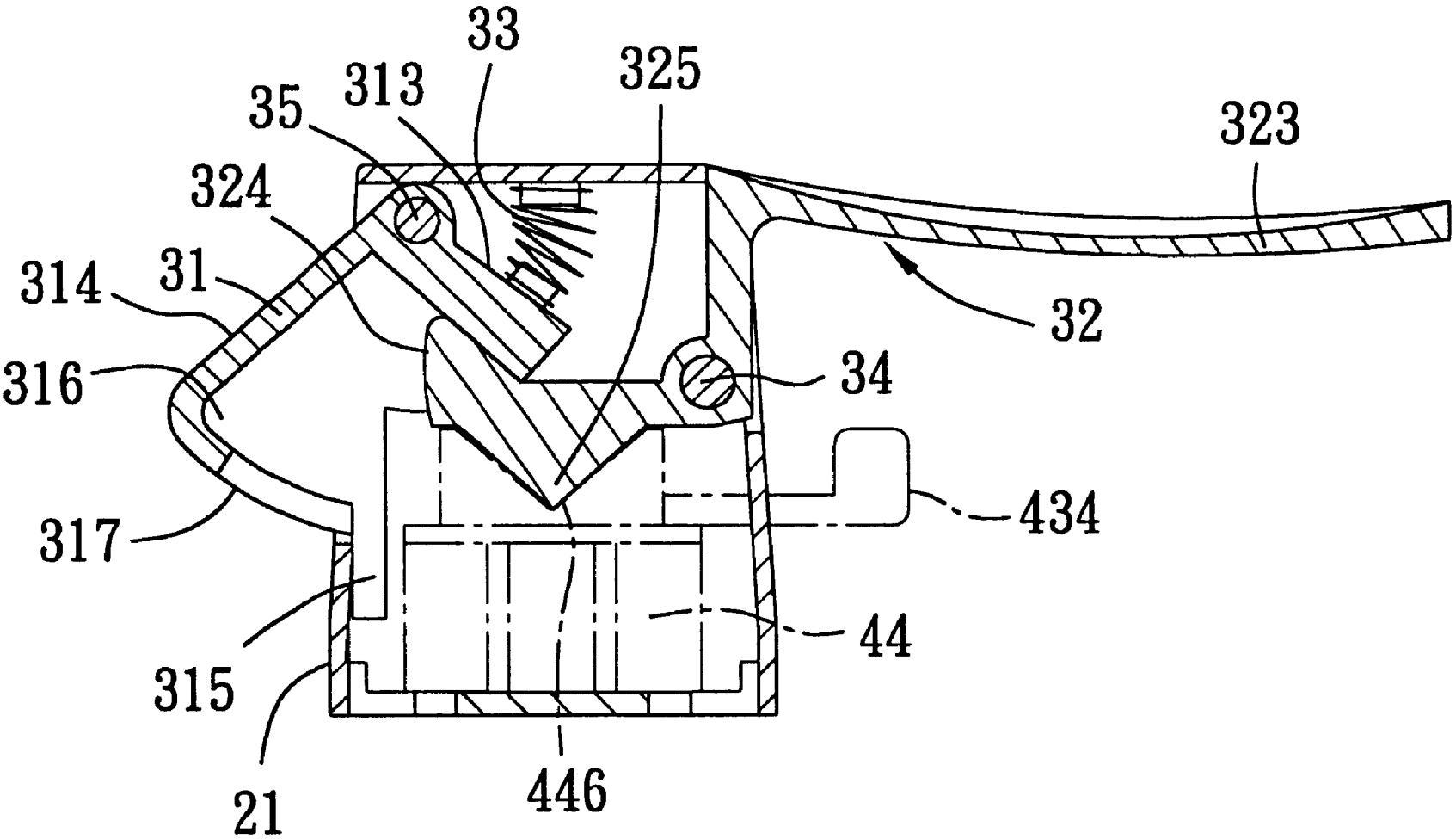
FIGS. 6A and 6B are sectional views to illustrate how the latch bolt of FIG. 2 is turned between extended and retracted positions.
Figure 6B:
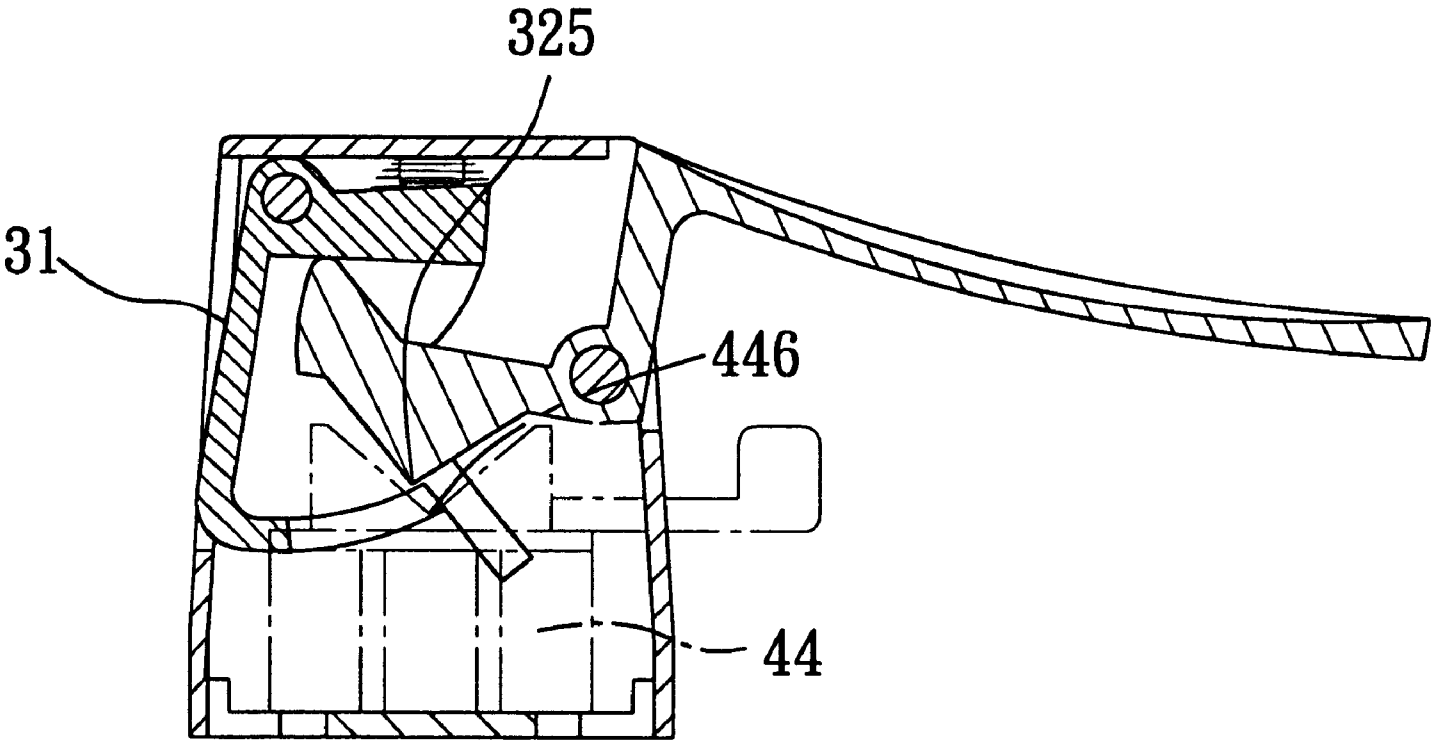
Figure 8:
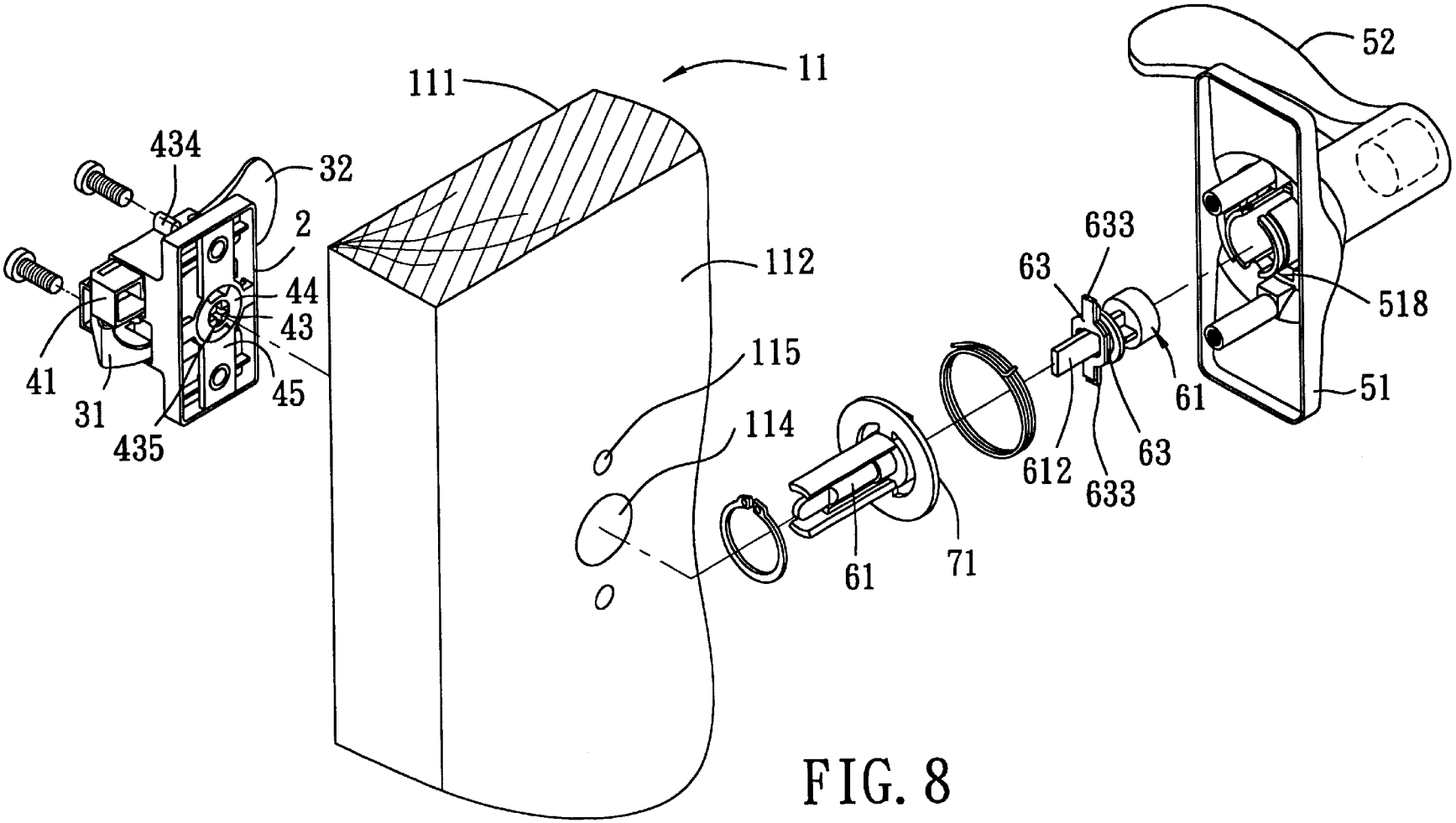
FIG. 8 is an exploded perspective view of the door lock-and-handle assembly of FIG. 1, with the locking member being positioned at a locked position.
Figure 9B:
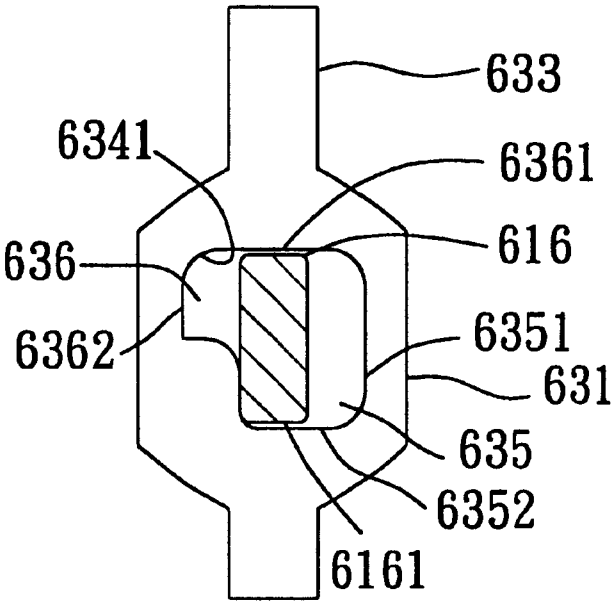
FIGS. 9A and 9B are schematic sectional views to illustrate how the locking member of the door lock-and-handle assembly of FIG. 1 is moved between locked and unlocked positions.
Figure 9A:
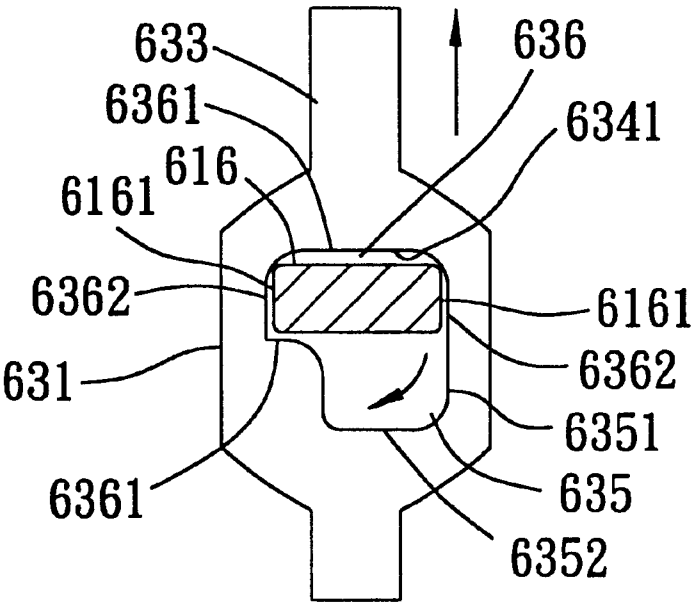

Referring to FIGS. 9A and 9B, in combination with FIGS. 1 and 8, the engaging portion 616 of the spindle 61 has a generally rectangular cross-section with two opposing short sides 6161 and defines a center line extending along the axis. The spindle opening 634 is L-shaped and has a first rectangular space 636 extending in a horizontal direction and having long and short sides 6361, 6362, and a second rectangular space 635 which extends in a vertical direction, which has long and short sides 6351, 6352, and which cooperates with the first rectangular space 636 to define the L-shape of the spindle opening 634. The opening-confining wall has an engaging side 6341 that confines the long side 6361 of the first rectangular space 636. The spindle 61 extends through the spindle opening 634 in a manner that the engaging portion 616 is received in the spindle opening 634 to turnably engage the engaging side 6341 of the opening-confining wall. As shown in FIGS. 1 and 9A, the engaging portion 616 is received in the first rectangular space 636 when the spindle 61 is positioned at the first angular position. As shown in FIGS. 8 and 9B, the engaging portion 616 is received in the second rectangular space 635 when the spindle 61 is positioned at the second angular position. The short side 6352 of the second rectangular space 635 has a length that is greater than the length between the center line and the short side 6161 of the engaging portion 616 so as to permit rotation of the spindle 61 in the spindle opening 634. The short side 6362 of the first rectangular space 636 has a length that is less than the length between the center line and the short side 6161 of the engaging portion 616 so that turning of the spindle 61 from the first angular position to the second angular position results in lifting of the locking member 63 to the locked position via upward pushing engagement between the engaging portion 616 and the engaging side 6341 of the opening-confining wall, and that turning of the spindle 61 from the second angular position to the first angular position results in lowering of the locking member 63 to the unlocked position by virtue of gravity.

Preferably, the mounting wall 51 is formed with two of the engaging grooves 518 that are diametrically opposing to each other, and the door lock-and-handle assembly includes two of the locking members 63 that are juxtaposed in a manner that the first rectangular spaces 636 in the central parts 631 of the locking members 63 are aligned in the axial direction and that the second rectangular spaces 635 in the central parts 631 of the locking members 63 are offset from each other and extend in opposite directions from the respective first rectangular spaces 636. The engaging tongues 633 of the locking members 63 engage the engaging grooves 518, respectively, when the locking members 63 are positioned at the locked position.

The driving member 525' of the handle 52 includes a pair of diametrically disposed arcuate driving levers 525 that extend through the spindle hole 515 and the lock receiving recess 516 and that cooperately define two opposing limiting slots 527 which extend in the axial direction and which are respectively and radially aligned with the engaging grooves 518. The engaging tongues 633 respectively extend through the limiting slots 527 and into the engaging grooves 518 so as to prevent rotation of the handle 52 about the axis when the locking members 63 are positioned at the locked position. The engaging tongues 633 disengage from the limiting slots 527 and the engaging grooves 518 so as to permit rotation of the handle 52 when the locking members 63 are positioned at the unlocked position.

The bolt receiving housing 2 further has a front open end 23, and a transmission mounting plate 45 mounted on the front open end 23 and formed with a central annular flange 451 that projects into the bolt receiving housing 2. The door lock-and-handle assembly further includes a latch bolt transmission 44 disposed turnably in the bolt receiving housing 2, turnable about the axis, and including a first circular plate 441 that extends in the radial direction, a cylindrical driven part 442 that projects from the first circular plate 441 in the axial direction into the annular flange 451, and that is formed with two diametrically disposed lever engaging grooves 444 extending in the axial direction, and a cam follower 445 that projects from the first circular plate 441 in a direction opposite to the cylindrical driven part 442 and that is formed with a V-shaped groove 446. The mounting wall 511 of the escutcheon 51 is further formed with an outer recess 517 radially spaced apart from the lock receiving recess 516. The door lock-and-handle assembly further includes a latch coupling member 7 that is turnable about the axis, and that includes a second circular plate 71 which is disposed in the outer recess 517, which extends in the radial direction, which is formed with a pair of diametrically disposed arcuate slots 714, and a pair of diametrically disposed arcuate coupling levers 715 which project from the second circular plate 71 through the spindle through hole 114 in the door panel 11 and into the lever engaging grooves 444. The driving levers 525 respectively extend through and engage the arcuate slots 714 so as to permit synchronous rotation of the latch coupling member 7 and the latch bolt transmission 44 about the axis upon turning of the handle 52. The door lock-and-handle assembly further includes a latch operating member 32 that is turnably associated with the latch bolt 31 and the latch bolt transmission 44 and that includes a pressing end 324 which is capable of pressing the curved wall 317 of the latch bolt 31 against the biasing action of the latch biasing member 33 so as to move the latch bolt 31 from the first extended position to the first retracted position upon turning of the latch operating member 32. The latch operating member 32 further includes a V-shaped cam portion 325 that extends from the pressing end 324 and that engages the V-shaped groove 446 in a cam mechanism manner so as to permit turning of the latch operating member 32 via synchronous rotation of the latch coupling member 7 and the latch bolt transmission 44 upon turning of the handle 52, thereby permitting displacement of the latch bolt 31 from the first extended position to the first retracted position. The latch operating member 32 further includes a latch operating lever 323 that extends outwardly of the bolt receiving housing 2 from one end of the V-shaped cam portion 325, and that has a pivot end 321 pivoted to the top wall 25 of the bolt receiving housing 2 via a pivot pin 34.

The latch coupling member 7 further includes an abutting protrusion 712 that projects from the second circular plate 71 toward the lock receiving recess 516. The door lock-and-handle assembly further includes a restoring member 73 disposed in the outer recess 517 between the latch coupling member 7 and the mounting wall 511 and having one end 731 that abuts against the mounting wall 511, and the other end 732 that abuts against the abutting protrusion 712 so as to permit restoring of the handle 52, the latch coupling member 7 and the latch bolt transmission 44 from an actuating position to a non-actuating position.

The first circular plate 441 and the cylindrical driven part 442 are formed with a first spindle through-hole 443. The cylindrical stud 432 is turnably received in the first spindle through-hole 443. The latch coupling member 7 further includes an annular spindle confining flange 713' that projects from the second circular plate 71 in the axial direction. The spindle confining flange 713' and the second circular plate 71 are formed with a second spindle through-hole 713. The spindle 61 includes first and second sections 613, 612. The first section 613 of the spindle 61 extends through the second spindle through-hole 713, and has a driving end 6131 extending into and engaging the spindle engaging hole 435 in the cylindrical stud 432, and an enlarged connecting end 6132 that is formed with a coupling groove 6133. The second section 612 of the spindle 61 extends through the spindle opening 634 in the central part 631 of each of the locking members 63 and has one end 6121 inserted fittingly into the coupling groove 6133, and the other end 6122 extending through the spindle-hole 515 in the mounting wall 511 of the escutcheon 51 and adapted to be driven by the key inserted in the keyhole 528 in the handle 52.

Referring to FIG. 8, in combination with FIG. 1, in case the dead bolt 41 is undesirably positioned at the second extended position when the door panel 11 is moving toward the door frame 12, as the latch bolt 31 strikes the striking plate 123 on the door frame 12 and is forced to turn to the first retracted position, the driven leg 411 on the dead bolt 41 will be moved by the latch bolt 31 so as to move the dead bolt 41 from the second extended position to the second retracted position, which, in turn, moves the locking members 63 to the unlocked position via synchronous rotation of the dead bolt transmission 43 and the spindle 61 so as to permit turning of the handle 52 when the latch bolt 31 is received in the bolt hole 122, thereby preventing undesirable locking of the dead bolt 41 in the bolt hole 122.

With the invention thus explained, it is apparent that various modifications and variations can be made without departing from the spirit of the present invention. It is therefore intended that the invention be limited only as recited in the appended claims.

I claim:

1. A door lock-and-handle assembly adapted to be mounted on a door panel having inner and outer sides, said lock-and-handle assembly comprising:

a bolt receiving housing adapted to be mounted on the inner side of the door panel and having a side wall that is formed with a bolt opening;

a latch bolt mechanism including a latch bolt mounted movably in said bolt receiving housing and turnable between first extended and retracted positions for moving in and out of said bolt opening, and a latch biasing member that urges said latch bolt to turn toward said first extended position;

a dead bolt mounted slidably in said bolt receiving housing adjacent to said latch bolt, and slidable in a transverse direction relative to said side wall between second extended and retracted positions for moving in and out of said bolt opening;

an escutcheon adapted to be mounted on the outer side of the door panel, aligned with said bolt receiving housing, and having a mounting wall that is formed with a lock receiving recess which is defined by a recess-confining wall, a spindle hole which is defined by a hole-confining wall extending from said recess-confining wall in an axial direction, and at least an engaging groove which is defined by a groove-confining wall extending from said recess-confining wall in a radial direction relative to said axial direction;

a handle mounted turnably on said mounting wall of said escutcheon, surrounding said spindle hole, formed with a keyhole that is aligned with said spindle hole in said axial direction, and having a driving member that extends through said spindle hole and said lock receiving recess and that is turnably coupled to said latch bolt so as to move said latch bolt between said first extended and retracted positions;

a spindle adapted to be turned by a key that is inserted into said keyhole, defining an axis in said axial direction, extending through said spindle hole, said lock receiving recess, and the door panel in said axial direction, and turnably coupled to said dead bolt so as to move said dead bolt between said second extended and retracted positions upon turning about said axis, said spindle having an engaging portion;

at least a locking member received in said lock receiving recess and having a central part that is formed with a spindle opening defined by an opening-confining wall, and an engaging tongue that projects from said central part and that is aligned with said engaging groove in said axial direction, said spindle extending through said spindle opening in a manner that said engaging portion is received in said spindle opening to turnably engage said opening-confining wall so that turning of said spindle from a first angular position to a second angular position results in radial movement of said locking member to a locked position, where said engaging tongue extends through said driving member and into said engaging groove to releasably engage said driving member and said engaging groove so as to prevent turning of said handle, and that turning of said spindle from said second angular position to said first angular position results in radial movement of said locking member to an unlocked position, where said engaging tongue disengages from said driving member and said engaging groove so as to permit turning of said handle; and a lock releasing member including a driven leg that projects from and that is movable together with said dead bolt so as to be disposed at a position proximate to said latch bolt when said dead bolt is positioned at said second extended position, and so as to be driven by said latch bolt to synchronously move said dead bolt from said second extended position to said second retracted position and said locking member from said locked position to said unlocked position when said latch bolt turns from said first extended position to said first retracted position, thereby permitting turning of said handle and preventing undesirable locking actions of said dead bolt and said locking member.

2. The door lock-and-handle assembly of claim 1, wherein said bolt receiving housing is further formed with upper and lower partitions receiving said dead bolt and said latch bolt respectively therein, and a pair of vertically spaced apart guide rails formed in said upper partition and that extending in said transverse direction, said dead bolt being formed with a sliding groove that receives said guide rails so as to guide sliding movement of said dead bolt, said latch bolt including an L-shaped wall that has a first wall portion urged by said latch biasing member, and a second wall portion transverse to said first wall portion, said latch bolt further including a curved wall opposite to said first wall portion and extending from and cooperating with one end of said second wall portion to define a leg receiving recess therebetween, and a stopper releasably engaging said side wall of said bolt receiving housing when said latch bolt is positioned at said first extended position so as to limit extent of outward movement of said latch-bolt, said driven leg projecting downwardly from said dead bolt and being received in said leg receiving recess when said dead bolt is positioned at said second extended position so as to be driven by said second wall portion when said latch bolt turns from said first extended position to said first retracted position.

3. The door lock-and-handle assembly of claim 2, wherein said dead bolt is formed with a finger receiving groove, and includes a finger urging member disposed adjacent to said finger receiving groove, said door lock-and-handle assembly further comprising a dead bolt transmission mounted turnably in said bolt receiving housing and including a sector-shaped plate disposed transverse to said side wall of said bolt receiving housing, and a driving finger that projects from said sector-shaped plate in said axial direction, that is received in and that engages said finger receiving groove so as to permit said dead bolt transmission to be turnable about said axis together with the sliding movement of said dead bolt, and that is urged by said finger urging member so as to be retained in said finger receiving groove, said dead bolt transmission further including a cylindrical stud that projects from said sector-shaped plate in a direction opposite to said driving finger and that is formed with a spindle engaging hole which receives and which engages said spindle so as to permit synchronous rotation of said dead bolt transmission and said spindle about said axis upon sliding movement of said dead bolt.

4. The door lock-and-handle assembly of claim 1, wherein said engaging portion of said spindle has a generally rectangular cross-section with two opposing short sides and defines a center line extending along said axis, said spindle opening being L-shaped and having a first rectangular space extending in a horizontal direction and having long and short sides, and a second rectangular space which extends in a vertical direction, which has long and short sides, and which cooperates with said first rectangular space to define the L-shape of said spindle opening, said opening-confining wall having an engaging side that confines said long side of said first rectangular space, said spindle extending through said spindle opening in a manner that said engaging portion is received in said spindle opening to turnably engage said engaging side of said opening-confining wall, said engaging portion being received in said first rectangular space when said spindle is positioned at said first angular position, said engaging portion being received in said second rectangular space when said spindle is positioned at said second angular position, said short side of said second rectangular space having a length that is greater than the length between said center line and said short side of said engaging portion so as to permit rotation of said spindle in said spindle opening, said short side of said first rectangular space having a length that is less than the length between said center line and said short side of said engaging portion so that turning of said spindle from said first angular position to said second angular position results in lifting of said locking member to said locked position via upward pushing engagement between said engaging portion and said engaging side of said opening-confining wall, and that turning of said spindle from said second angular position to said first angular position results in lowering of said locking member to said unlocked position by virtue of gravity.

5. The door lock-and-handle assembly of claim 4, wherein said mounting wall is formed with two of said engaging grooves that are diametrically opposing to each other, and said door lock-and-handle assembly comprises two of said locking members that are juxtaposed in a manner that said first rectangular spaces in said central parts of said locking members are aligned in said axial direction and that said second rectangular spaces in said central parts of said locking members are offset from each other and extend in opposite directions from the respective first rectangular spaces, said engaging tongues of said locking members engaging said engaging grooves, respectively, when said locking members are positioned at said locked position.

6. The door lock-and-handle assembly of claim 5, wherein said driving member of said handle includes a pair of diametrically disposed arcuate driving levers that extend through said spindle hole and said lock receiving recess and that cooperately define two opposing limiting slots which extend in said axial direction and which are respectively and radially aligned with said engaging grooves, said engaging tongues respectively extending through said limiting slots and into said engaging grooves so as to prevent rotation of said handle about said axis when said locking members are positioned at said locked position, said engaging tongues disengaging from said limiting slots and said engaging grooves so as to permit rotation of said handle when said locking members are positioned at said unlocked position.

7. The door lock-and-handle assembly of claim 6, wherein said bolt receiving housing further has a front open end, and a transmission mounting plate mounted on said front open end and formed with a central annular flange that projects into said bolt receiving housing, said door lock-and-handle assembly further comprising a latch bolt transmission disposed turnably in said bolt receiving housing, turnable about said axis, and including a first circular plate that extends in said radial direction, a cylindrical driven part that projects from said first circular plate in said axial direction into said annular flange, and that is formed with two diametrically disposed lever engaging grooves extending in said axial direction, and a cam follower that projects from said first circular plate in a direction opposite to said cylindrical driven part and that is formed with a V-shaped groove, said mounting wall of said escutcheon being further formed with an outer recess radially spaced apart from said lock receiving recess, said door lock-and-handle assembly further comprising a latch coupling member that is turnable about said axis, and that includes a second circular plate which is disposed in said outer recess, which extends in said radial direction, which is formed with a pair of diametrically disposed arcuate slots, and a pair of diametrically disposed arcuate coupling levers which project from said second circular plate through the door panel and into said lever engaging grooves, said driving levers respectively extending through and engaging said arcuate slots so as to permit synchronous rotation of said latch coupling member and said latch bolt transmission about said axis upon turning of said handle, said door lock-and-handle assembly further comprising a latch operating member that is turnably associated with said latch bolt and said latch bolt transmission and that includes a pressing end which is capable of pressing said curved wall of said latch bolt against the biasing action of said latch biasing member so as to move said latch bolt from said first extended position to said first retracted position upon turning of said latch operating member, said latch operating member further including a V-shaped cam portion that extends from said pressing end and that engages said V-shaped groove in a cam mechanism manner so as to permit turning of said latch operating member via synchronous rotation of said latch coupling member and said latch bolt transmission upon turning of said handle, thereby permitting displacement of said latch bolt from said first extended position to said first retracted position, said latch coupling member further including an abutting protrusion that projects from said second circular plate toward said lock receiving recess, said door lock-and-handle assembly further comprising a restoring member disposed in said outer recess between said latch coupling member and said mounting wall and having one end that abuts against said mounting wall, and the other end that abuts against said abutting protrusion so as to permit restoring of said handle, said latch coupling member and said latch bolt transmission from an actuating position to a non-actuating position.

8. The door lock-and-handle assembly of claim 7, wherein said first circular plate and said cylindrical driven part are formed with a first spindle through-hole, said cylindrical stud being turnably received in said first spindle through-hole, said latch coupling member further including an annular spindle confining flange that projects from said second circular plate in said axial direction, said spindle confining flange and said second circular plate being formed with a second spindle through-hole, said spindle including first and second sections, said first section of said spindle extending through said second spindle through-hole and having a driving end extending into and engaging said spindle engaging hole in said cylindrical stud, and an enlarged connecting end that is formed with a coupling groove, said second section of said spindle extending through said spindle opening in said central part of each of said locking members and having one end inserted fittingly into said coupling groove, and the other end extending through said spindle hole in said mounting wall of said escutcheon and adapted to be driven by the key inserted in said keyhole in said handle.

* * * * *